US005894502A

United States Patent [19]

Beyerlein et al.

[11] Patent Number: 5,894,502

[45] Date of Patent: Apr. 13, 1999

[54] HIGH-FREQUENCY VOLTAGE GENERATOR FOR AN X-RAY TUBE

[75] Inventors: Walter Beyerlein, Bubenreuth; Werner Kuehnel, Uttenreuth, both of Germany

[73] Assignee: Siemens Aktiengesellschaft, Munich, Germany

[21] Appl. No.: 08/874,149

[22] Filed: Jun. 13, 1997

[30] Foreign Application Priority Data

Aug. 1, 1996 [DE] Germany ..... 19631143

[51] Int. Cl.[6] ..... H05G 1/10

[52] U.S. Cl. ..... 378/101; 378/210

[58] Field of Search ..... 378/101

[56] References Cited

U.S. PATENT DOCUMENTS 4,439,869 3/1984 Hermeyer et al. ..... 378/101

5,123,038 6/1992 Negle et al. ..... 378/101

5,155,754 10/1992 Ebersberger et al. .

FOREIGN PATENT DOCUMENTS 2 095 007 11/1980 United Kingdom .

*Primary Examiner*—Craig E. Church

*Attorney, Agent, or Firm*—Hill & Simpson

[57] ABSTRACT

In a high-voltage generator with an X-ray tube having a metallic middle part, unfavorable effects due to a part of the current flowing off via the grounded metallic middle part is avoided by the overall voltage across the X-ray tube being produced by one inverter and the cathode voltage of the X-ray tube is generated by another inverter, each having a high-voltage rectifier connected thereto. The respective voltages are regulated by controlling the respective inverters.

2 Claims, 1 Drawing Sheet

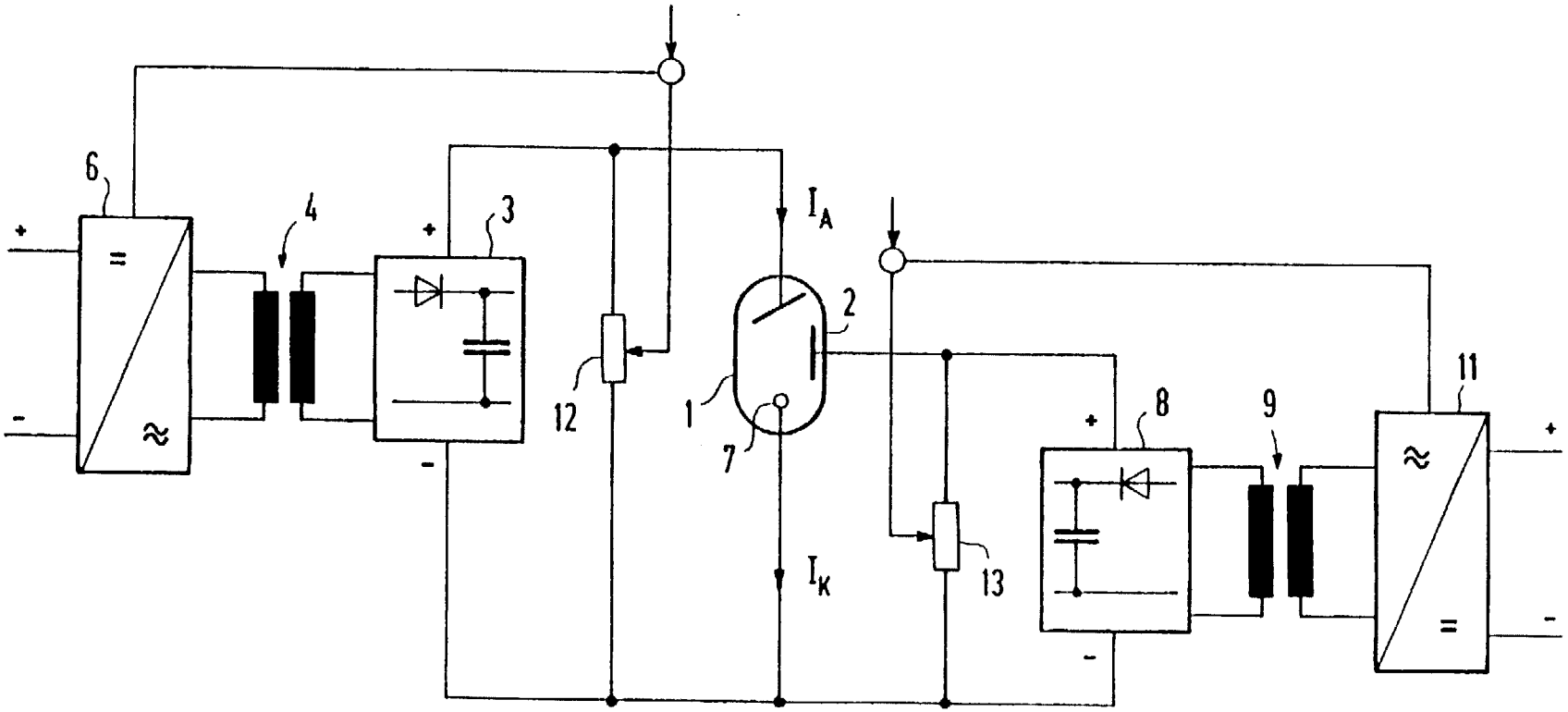
+
-
11
9
8
13
2
$I_A$
$I_K$
7
1
12
3
4
6

HIGH-FREQUENCY VOLTAGE GENERATOR FOR AN X-RAY TUBE

BACKGROUND OF THE INVENTION

1. Field of the Invention

The present invention is directed to a high-frequency voltage generator for supplying an X-ray tube, the X-ray tube being of the type having a metallic, centrally disposed part.

2. Description of the Prior Art

A high-frequency voltage generator for an X-ray tube is known that supplies an X-ray tube of the type having metallic, or centrally disposed part. The cathode current is thereby unequal to the anode current since a part of the current flows off via the grounded metal middle part. Since the positive side of the high-voltage supply then is less loaded than the negative side, an asymmetrical voltage division with a higher anode voltage occurs. Due to the asymmetrical voltage division, thus, a shift of the center point of the high-voltage occurs.

SUMMARY OF THE INVENTION

An object of the present invention is to provide a high-frequency generator for supplying an X-ray tube having a metallic middle part wherein a shift of the center point of the high-voltage is avoided.

The above object is achieved in accordance with the principles of the present invention in a high-frequency voltage generator for supplying an X-ray tube having a metallic middle part, the generator having a first high voltage rectifier with a (preceding inverter inverse rectifier) connected across the x-ray tube for supplying the overall voltage to the X-ray tube, and a second high voltage rectifier with another preceding inverter connected across the metallic middle part and the cathode, the first and second high voltage rectifiers and respectively following inverters being separately controlled by a control circuit.

In the inventive high-frequency high-voltage generator, an rectifier is provided for the overall voltage across the X-ray tube and another inverse inverter is provided for the cathode voltage. These voltages are regulated independently of one another by controlling the frequency of each inverse rectifier. The ripples of these voltages therefore have different frequencies, but this is not disturbing since the influence of the cathode voltage ripple on the cathode or on the anode current is slight. The metallic middle part acts like the grating of an amplifier with little steepness.

BRIEF DESCRIPTION OF THE DRAWING

The single FIGURE is a circuit diagram of a high voltage generator for supplying an X-ray tube, constructed and operating in accordance with the principles of the present invention.

DESCRIPTION OF THE PREFERRED EMBODIMENTS

The drawing shows an X-ray tube 1 with metallic middle part 2. The overall voltage across the X-ray tube 1 is supplied by a high-voltage rectifier 3. The high-voltage rectifier 3 is connected to a inverter 6 via a high-voltage transformer 4. The inverter 6 is supplied from the mains via a rectifier in a known way.

The cathode voltage of the X-ray tube 1, i.e. the voltage between the metallic middle part 2 and the cathode 7, is supplied by a high-voltage rectifier 8 that is connected to a inverter 11 via a high-voltage transformer 9. The inverter 11 is also supplied from the mains via a rectifier in a known way.

The overall voltage at the X-ray tube 1 is controlled as a manipulated variable dependent on the frequency of the inverter 6. The actual value is taken at a potentiometer 12. The cathode voltage is regulated as a manipulated variable dependent on the frequency of the inverter 11. The actual value is taken at a potentiometer 13.

The illustrated generator is particularly suited for X-ray tubes having a highly pronounced asymmetry. Both inverters 6 and 11 are loaded about the same in the asymmetry range $I_A=0.35*I_K$ which is generally the range of interest. $I_A$ is thereby the anode current, $I_K$ the cathode current. As a result, the two inverters 6 and 11 can be identically structured and equipped with the same power semiconductors, thereby making of the high voltage generator easier to facilitate realization.

A further advantage is that a certain voltage asymmetry can be intentionally set, thereby reducing the anode dissipated power, and thus also reducing heating of the anode.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

an x-ray tube having a housing containing an anode and a cathode between which electrons flow, and a metallic part disposed in said housing between said anode and said cathode at a location so that said metallic part has substantially no interaction with said electrons;

a first inverter connectible to a mains supply and having an output;

a first high voltage rectifier connected across said output of said first inverter and connected across said cathode and said anode of said x-ray tube for supplying an overall voltage to said x-ray tube;

a second inverter connectible to a mains supply, and having an output;

a second high voltage rectifier connected across said output of said second inverter and connected between said metallic part and said cathode for supplying a cathode voltage to said cathode; and control means connected to said first inverter and to said second inverter for individually controlling said overall voltage and said cathode voltage.

2. An x-ray radiator as claimed in claim 1 wherein said first inverter operates at a first inverter operating frequency and wherein said second inverter operates at a second inverter operating frequency, and wherein said control means comprises means for controlling each of said first inverter operating frequency and said second inverter operating frequency for individually controlling said overall voltage and said cathode voltage.

* * * * *